US007839335B2

(12) United States Patent
Chen

(10) Patent No.: US 7,839,335 B2
(45) Date of Patent: Nov. 23, 2010

(54) ANTENNA AND WIRELESS NETWORK DEVICE HAVING THE SAME

(75) Inventor: Yu Ren Chen, Luodong Township, Yilan County (TW)

(73) Assignee: Cameo Communications Inc. (TW)

( * ) Notice: Subject to any disclaimer, the term of this patent is extended or adjusted under 35 U.S.C. 154(b) by 313 days.

(21) Appl. No.: 11/790,467

(22) Filed: Apr. 25, 2007

(65) Prior Publication Data

US 2008/0268908 A1 Oct. 30, 2008

(51) Int. Cl.
*H01Q 1/38* (2006.01)

(52) U.S. Cl. ..... 343/700 MS; 343/702; 343/873

(58) Field of Classification Search ..... 343/700 MS, 343/702, 829, 846, 873
See application file for complete search history.

(56) References Cited

U.S. PATENT DOCUMENTS 6,344,823 B1 * 2/2002 Deng ..... 343/700 MS
6,670,923 B1 * 12/2003 Kadambi et al. ..... 343/700 MS
6,724,348 B2 * 4/2004 Fang ..... 343/702
6,831,607 B2 * 12/2004 Hebron et al. ..... 343/700 MS
6,922,172 B2 * 7/2005 Oshiyama et al. ..... 343/700 MS
6,995,720 B2 * 2/2006 Shikata ..... 343/702
7,705,786 B2 * 4/2010 Iellici et al. ..... 343/702

* cited by examiner

*Primary Examiner*—Tho G Phan

(57) ABSTRACT

An antenna applied to a wireless network device comprises a base, a pair of embedded portions, and an antenna portion. The base has two sides opposite to each other. Each of the embedded portions has a side wall portion and a locking wing portion. The side wall portion is substantially vertical to the base and connected to the sides of the base, while the locking wing portion is connected to the side wall portion, substantially parallel to the base, and spaced apart from the base with a first height. The antenna portion is provided with a ground member, a radiation member, and a signal member. The ground member is substantially vertical to the base, connected to one of the two sides of the base, and spaced apart from the embedded portion with an interval. The radiation member is connected to the ground member, substantially parallel to the base, and spaced apart from the base with a second height. The signal member is connected to the radiation member, substantially vertical to the base, and formed with a free end separated from the base. When the antenna is positioned in at least one slot formed on a substrate of the wireless network device, the radiation member is spaced apart from the substrate with a height difference between the second height and the first height.

7 Claims, 9 Drawing Sheets

ANTENNA AND WIRELESS NETWORK DEVICE HAVING THE SAME

BACKGROUND OF INVENTION

1. Field of the Invention

The present invention relates to an antenna, and more particularly to a Plated Inverted-F Antenna (PIFA) applied to a MIMO wireless network device and a wireless network device having the same.

2. Description of the Prior Art

Referring now to FIG. 1, an outline perspective view of a traditional wireless network device 10 is illustrated. Generally, the wireless network device 10 is provided with a body 11, an internal circuit device 12 formed in the body 11, a connector 13 formed on a first end of the body 11 for connecting to an external host (not shown), and an antenna signal transmitter/receiver 14 formed on a second end of the body 11 opposite to the first end thereof. Broadly, the antenna signal transmitter/receiver 14 has an outer housing made of non-metal material. When the wireless network device 10 is connected to the external host, the antenna signal transmitter/receiver 14 must be exposed out of the external host in order to effectively receive and transmit wireless signals.

Referring now to FIG. 2, a schematic view of a traditional internal circuit device 20 of a MIMO wireless network device is illustrated. The internal circuit device 20 of the MIMO wireless network device is provided with a substrate 21, a control circuit 22 formed on the substrate 21, a ground portion 23 covered on a predetermined region of the substrate 21, and an antenna unit 24 electrically connected to the control circuit 22. The antenna design of wireless network device fit to MIMO specification is an antenna unit having three antennae for constituting three transmitters and two receivers. For example, the traditional antenna unit 24 shown in FIG. 2 is provided with a first antenna 241 formed on a middle portion thereof, a second antenna 242 formed on one side of the first antenna 241, and a third antenna 243 formed on the other side of the first antenna 241, all of which are adjacent to each other. The first antenna 241 is a T type dipole antenna extended toward the direction of an X axis shown in the right portion of FIG. 2. Furthermore, the second antenna 242 and the third antenna 243 are two monopole antennae disposed on two sides of the first antenna 241 and respectively extended toward the opposite direction of a Y axis shown in FIG. 2. Due to the antenna design of the traditional internal circuit device 20 as described above are selected from a printed antenna formed on the substrate 21, the second antenna 242 and the third antenna 243 are usually designed into different shapes for improving the radiation pattern and the gain value on an X-Y plane shown in FIG. 2, but the gain value on the vertical direction of a Z axis shown in FIG. 2 can not be improved at all. However, the present trend for designing wireless network devices is a vertical stand design for minimizing the occupied space of the wireless network devices, while enhancing the modern and high-technology appearance thereof. Apparently, the traditional printed antenna generates unwanted gain on the vertical direction of the Z axis, so that the traditional printed antenna can not satisfy the need of the vertical stand design of the wireless network devices.

For example, referring now to FIGS. 3 and 4, a detected radiation pattern on an X-Y plane of the second and third antennae 242,243 of the traditional MIMO antenna unit 24 shown in FIG. 2 is illustrated. As shown in the radiation pattern of FIGS. 3 and 4, the second antenna 242 has a maximum gain value on the vertical direction about −13.97 dBi, and the third antenna 243 has a maximum gain value on the vertical direction about −15.97 dBi. However, the maximum gain values are obviously lower than a lower limit value (generally, greater than about −10 dBi) which is set for satisfying consumers' acceptance, so that it is needed to improve the antennae design.

It is therefore tried by the inventor to develop an antenna and a wireless network device having the same to solve the problems existed in the traditional wireless network device as described above.

SUMMARY OF INVENTION

A primary object of the present invention is to provide an antenna applied to a wireless network device, which is an embedded antenna for reducing the height thereof and improving the antenna radiation pattern thereof so as to increase the gain value on the vertical direction thereof and minimize the dead angle thereof.

A secondary object of the present invention is to provide an antenna, which is an improved Plated Inverted-F Antenna (PIFA) advantageous to manufacture the antenna and assemble the antenna into a wireless network device.

A third object of the present invention is to provide an antenna, which is provided with a monopole antenna and a pair of antennae of the present invention respectively disposed on two sides of the monopole antenna, so that the antenna is easy to manufacture without increasing the thickness of a MIMO wireless network device.

To achieve the above object, the antenna of a preferred embodiment of the present invention comprises a base, a pair of embedded portions, and an antenna portion. The base has two sides opposite to each other. Each of the embedded portions has a side wall portion and a locking wing portion, wherein the side wall portion is substantially vertical to the base and connected to the sides of the base, and the locking wing portion is connected to the side wall portion, substantially parallel to the base, and spaced apart from the base with a first height. The antenna portion is provided with a ground member, a radiation member, and a signal member. The ground member is substantially vertical to the base, connected to one of the two sides of the base, and spaced apart from the embedded portion with an interval. The radiation member is connected to the ground member, substantially parallel to the base, and spaced apart from the base with a second height. The signal member is connected to the radiation member, substantially vertical to the base, and formed with a free end separated from the base.

When the antenna is applied to a wireless network device according to the present invention, the wireless network device comprises a substrate, a control circuit, a ground portion, and at least one feed line. The substrate is made of dielectric material, and formed with at least one slot. The control circuit is formed on the substrate for providing a wireless transmission function. The ground portion is electrically grounded, and covers at least one portion of the substrate. The feed line passes through the ground portion, and is electrically connected to the control circuit for providing a wireless transmission and receiving function. When the antenna of the present invention is positioned in the slot, the side wall portion is connected to the sides and attached to an inner side of the slot, so that the locking wing portion is attached to a surface of the substrate. Meanwhile, the radiation member is spaced apart from the substrate with a height difference between the second height and the first height. Furthermore, the ground member is connected to the ground portion, and the free end of the signal member is connected to the feed line. Thus, the antenna of the present invention improves the radiation pattern of the wireless network device and enhances the gain value on the vertical direction thereof for considerably increasing the antenna efficiency.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION

The present invention provides an antenna and a wireless network device having the same, the principle thereof is to apply a Plated Inverted-F Antenna (PIFA) to a MIMO wireless network device which is provided with a MIMO antenna unit with three antennae, wherein an intermediate antenna is selected from a monopole antenna, and two antennae disposed on two sides of the intermediate antenna are selected from PIFA antennae. Thus, the gain value on the vertical direction of an X-Y plane of the two sides of the intermediate antenna can be improved and enhanced, and the height of a radiation member within an internal circuit device can be minimized without increasing the thickness of the MIMO wireless network device.

Figure 5:
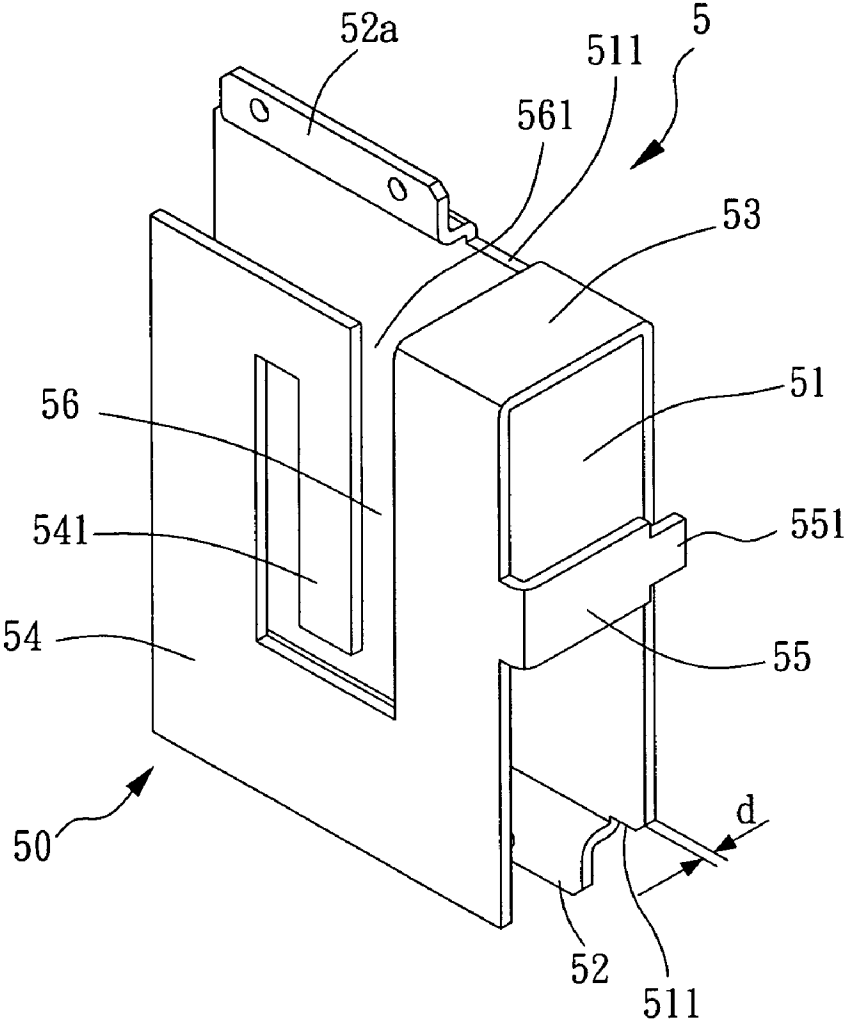
FIG. 5 is a perspective view of an antenna according to a preferred embodiment of the present invention.
Figure 7:
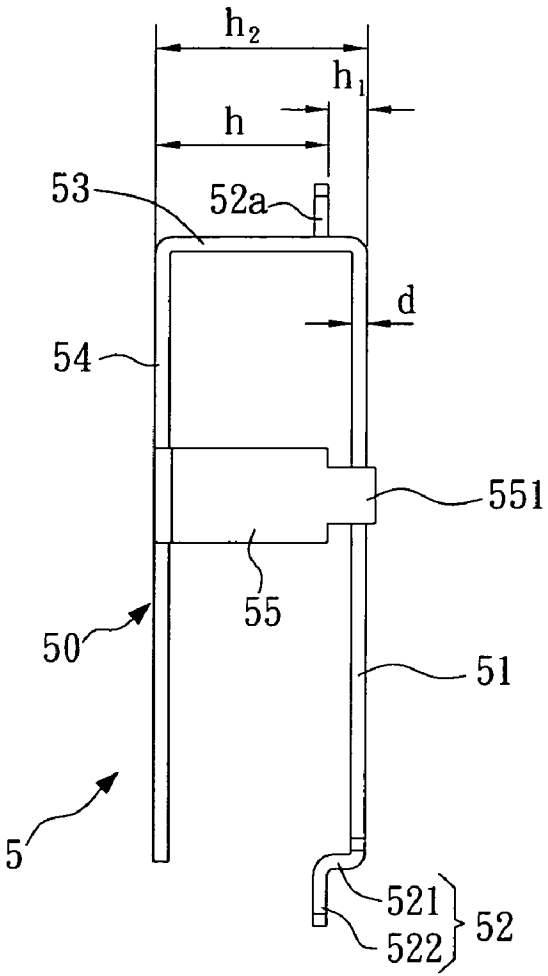
FIG. 7 is a front view of the antenna according to the preferred embodiment of the present invention.
Figure 6:
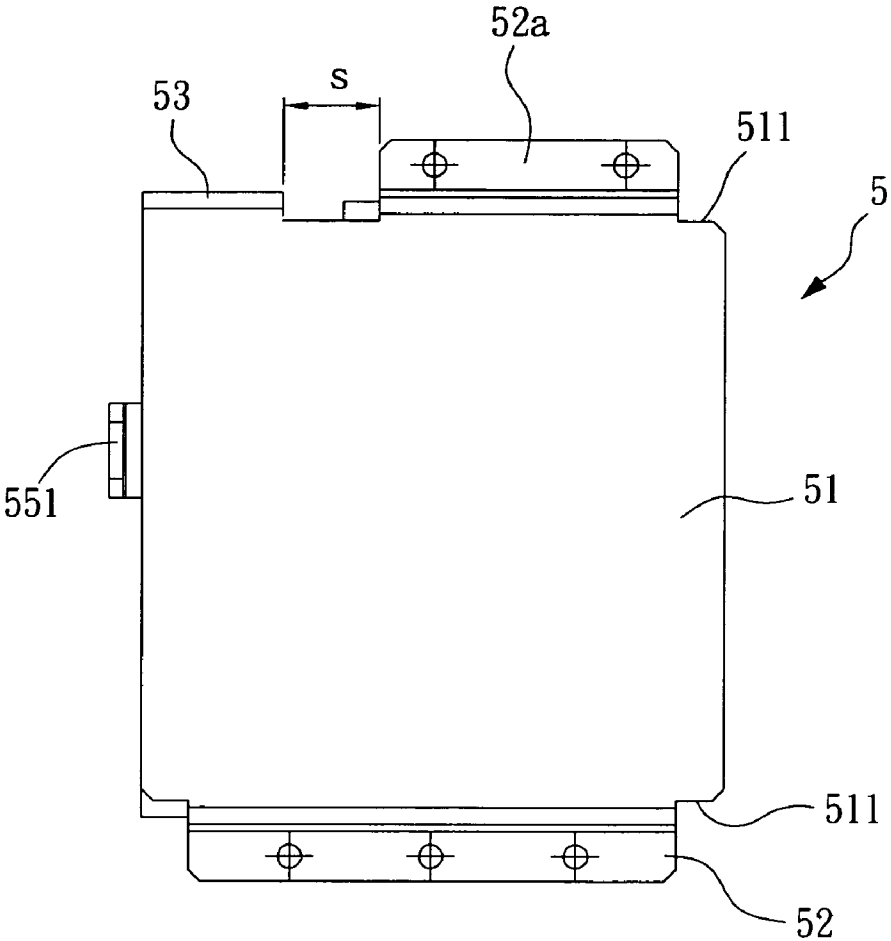
FIG. 6 is a side view of the antenna according to the preferred embodiment of the present invention.

Referring now to FIGS. 5, 6, and 7, a perspective view, a side view, and a front view of an antenna according to a preferred embodiment of the present invention are illustrated, respectively. As shown, the antenna designated by numeral 5 is a one-piece metal plate bent by punching (i.e., stamping), and made of conductive metal material, such as copper, iron, aluminum, and etc. Except for bent portions of the antenna 5, other portions thereof substantially have an identical thickness d. The antenna 5 comprises a base 51, a pair of embedded portion 52, and an antenna portion 50. The base 51 is substantially shaped in a rectangular configuration, and provided with a pair of sides 511 opposite to each other. Each of the embedded portions 52 has a side wall portion 521 and a locking wing portion 522. The side wall portion 521 is formed by bending the two sides 511 of the base 51, while it is substantially vertical to the base 51, and connected to the sides 511. The locking wing portion 522 is connected to the side wall portion 521, and formed by bending the side wall portion 521, while it is substantially parallel to the base 51, and spaced apart from the base 51 with a first height h1. In the preferred embodiment of the present invention, in order to easily manufacture the antenna portion 50, one of the embedded portions 52 (i.e. an embedded portion 52*a*) has a length smaller than the other thereof so that one of the sides 511 can be easily connected to the antenna portion 50. Alternatively, two of the embedded portions 52 can selectively have the same length, i.e. providing two embedded portions 52*a*, which have identical smaller length and symmetrical configuration. The size (i.e. the length) of the embedded portions 52 can be optionally varied as described above by the person skilled in the art without departing from the scope and the spirit of the present invention, and the detailed description thereof will be omitted hereinafter.

Referring still to FIGS. 5, 6, and 7, the antenna portion 50 is provided with a ground member 53, a radiation member 54, and a signal member 55. The ground member 53 is connected to one of the sides 511 of the base 51 where the embedded portion 52*a* with the smaller length is formed. Furthermore, the ground member 53 is spaced apart from the embedded portion 52*a* with an interval, while the ground member 53 is substantially vertical to the base 51. The radiation member 54 is connected to the ground member 53, substantially parallel to the base 51, and spaced apart from the base 51 with a second height h2 which is greater than the first height h1. In the preferred embodiment of the present invention, the first height h1 is preferably ranged from 0.3 mm to 2.0 mm, and the second height h2 is preferably ranged from 2.5 mm to 12.0 mm. Moreover, the radiation member 54 is provided with a slot 56 with a predetermined configuration, and the slot 56 has an opening 561 corresponding to the ground member 53. The slot 56 is preferably shaped in a spiral configuration, so that the radiation member 54 is formed with an end portion 541. In other words, the predetermined configuration and size of the radiation member 54 can be used to vary the band width or frequency band applied to the radiation member 54. The signal member 55 is connected to the radiation member 54, substantially vertical to the base 51, and formed with a free end 551 separated from the base 51.

Referring back to FIG. 8, a schematic view of a wireless network device having the antenna according to the preferred embodiment of the present invention is illustrated. As shown, the wireless network device designated by numeral 6 comprises a substrate 61, a control circuit 62, a ground portion 63, at least one feed line 64, and at least one antenna 5 as described above. The substrate 61 is made of dielectric material, and substantially shaped in a flat rectangular configuration. The substrate 61 is formed with at least one slot 611 having a configuration substantially corresponding to a configuration of the base 51 of the antenna 5. In the preferred embodiment of the present invention, the substrate 61 is formed with a pair of the slots 611 opposite to each other and disposed on two longer sides of the substrate 61. The control circuit 62 is substantially formed on the substrate 61, and has a plurality of integrated circuits and a plurality of electronic elements for providing a wireless transmission function. The control circuit 62 as described above can be selected from various traditional wireless transmission technologies without departing from the scope and the spirit of the invention, and the detailed description thereof will be omitted hereinafter.

Figure 8:
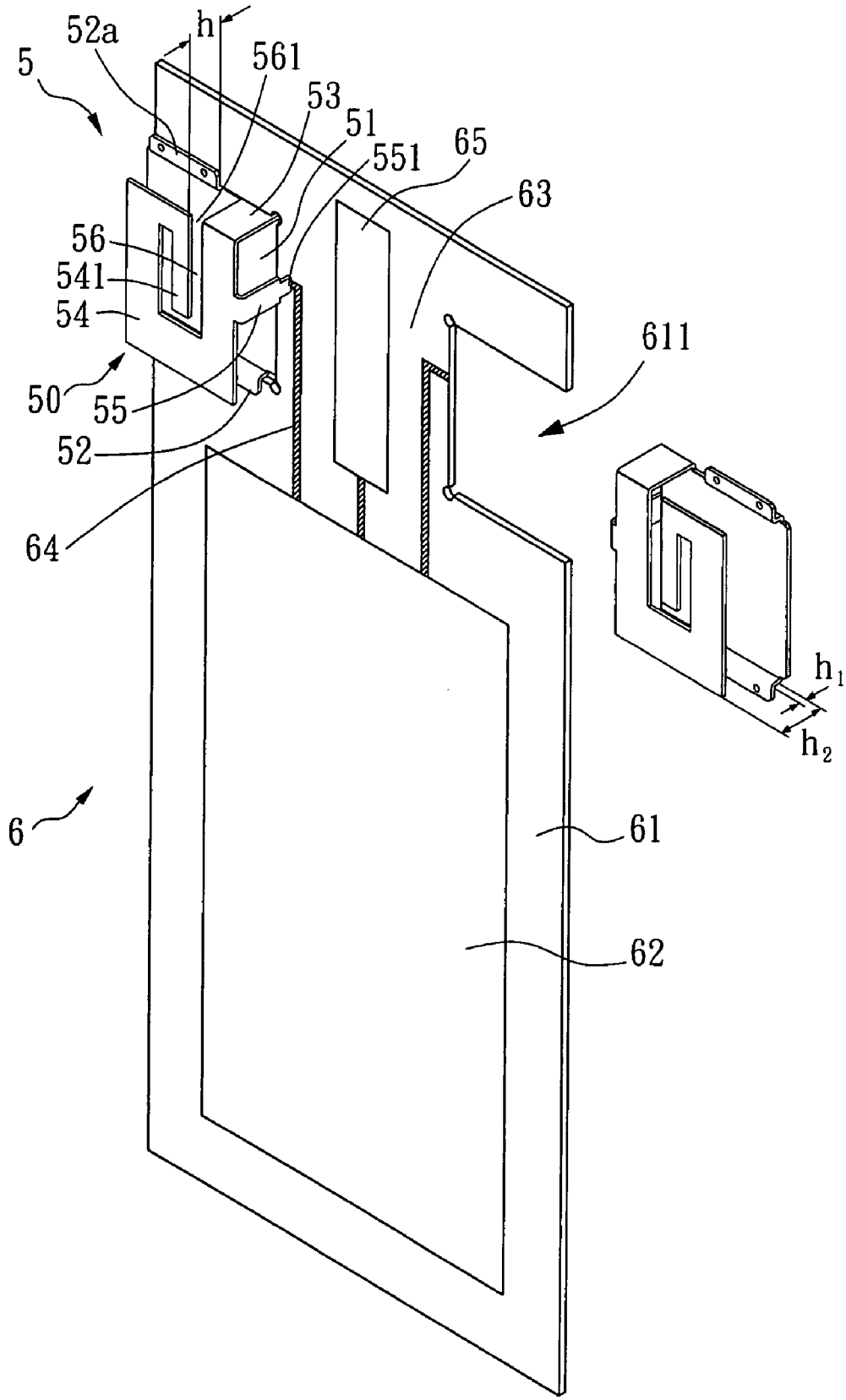
FIG. 8 is a schematic view of a wireless network device having the antenna according to the preferred embodiment of the present invention.

Referring still to FIG. 8, the ground portion 63 is electrically grounded (GND), and covers at least one portion of the substrate 61. The wireless network device 6 further comprises a panel antenna 65 (i.e., printed antenna) formed on an exposed region of the substrate 61, which is not covered by the ground portion 63. In the preferred embodiment of the present invention, the panel antenna 65 is disposed between the two slots 611 opposite to each other, and substantially disposed on a central portion of the substrate 61. The panel antenna 65 is preferably selected from a monopole antenna printed on the substrate 61.

Referring still to FIG. 8, in the preferred embodiment of the present invention, the antenna 5 includes a plurality of elements the same as or similar to the antenna 5 as described in FIGS. 5, 6, and 7, so that the similar element is designated by the same numeral. Furthermore, each of the antennae 5 is aligned to the two slots 611, so that the present invention preferably provides a pair of the antennae 5 which are substantially positioned on two sides of the panel antenna 65 in a symmetrical manner. The two antennae 5 are substantially shaped in a symmetrical configuration. Therefore, the structure of one of the antennae 5 and the interconnection with the slots 611 are described more detailed hereinafter. When one of the antennae 5 is directly embedded and positioned into one of the slot 611, the side wall portion 521 is attached to an inner side of the slot 611, so that the locking wing portion 522 is attached to an upper surface of the substrate 61, and electrically connected to the ground portion 63. Then, the locking wing portion 522 is fixed on the substrate 61 by soldering, embedding, or screwing. Furthermore, the ground member 53 is attached and connected to the ground portion 63 of the substrate 61, so that the free end 551 of the signal member 55 is connected to the feed line 64 of the substrate 61. Because the radiation member 54 is connected to the ground member 55, the radiation member 54 is substantially parallel to the substrate 61. If the thickness d of the antenna 5 is small and omitted, the thickness of the substrate 61 is substantially equal to (i.e. corresponding to) the first height h1. The radiation member 54 is spaced apart from the substrate 61 with a height difference h between the second height h2 and the first height h1, i.e. h2-h1. In other words, due to the embedded portion 52 of the antennae 5 is embedded in the slot 611 of the substrate 61, the height of the radiation member 54 relative to the substrate 61 is reduced about a length substantially equal to the thickness (i.e. h1) of the substrate 61. Thus, when the antenna 5 selected from PIFA antenna is applied to the wireless network device 6 selected from MIMO wireless network device, the overall height of the MIMO wireless network device can be minimized to an acceptable degree.

When an antenna is applied to the MIMO wireless network device, the antenna is generally provided with three antennae for constituting an antenna unit having three transmitters and two receivers. Thus, the panel antenna 65 and the pair of the antennae 5 symmetrically disposed on two sides of the panel antenna 65 are respectively connected to one of the corresponding feed lines 64, all of which are passed through the ground portion 63, so that the panel antenna 65 and the pair of the antennae 5 are electrically connected to the control circuit 62 for providing a wireless transmission and receiving function. Each of the antennae 5 is separated from the panel antenna 65 by the ground portion 53. Furthermore, in the preferred embodiment of the present invention, the present invention provides a plurality of the feed lines 64 selected from 50 ohm microstrip lines for enhancing the power transition efficiency.

Figure 1:
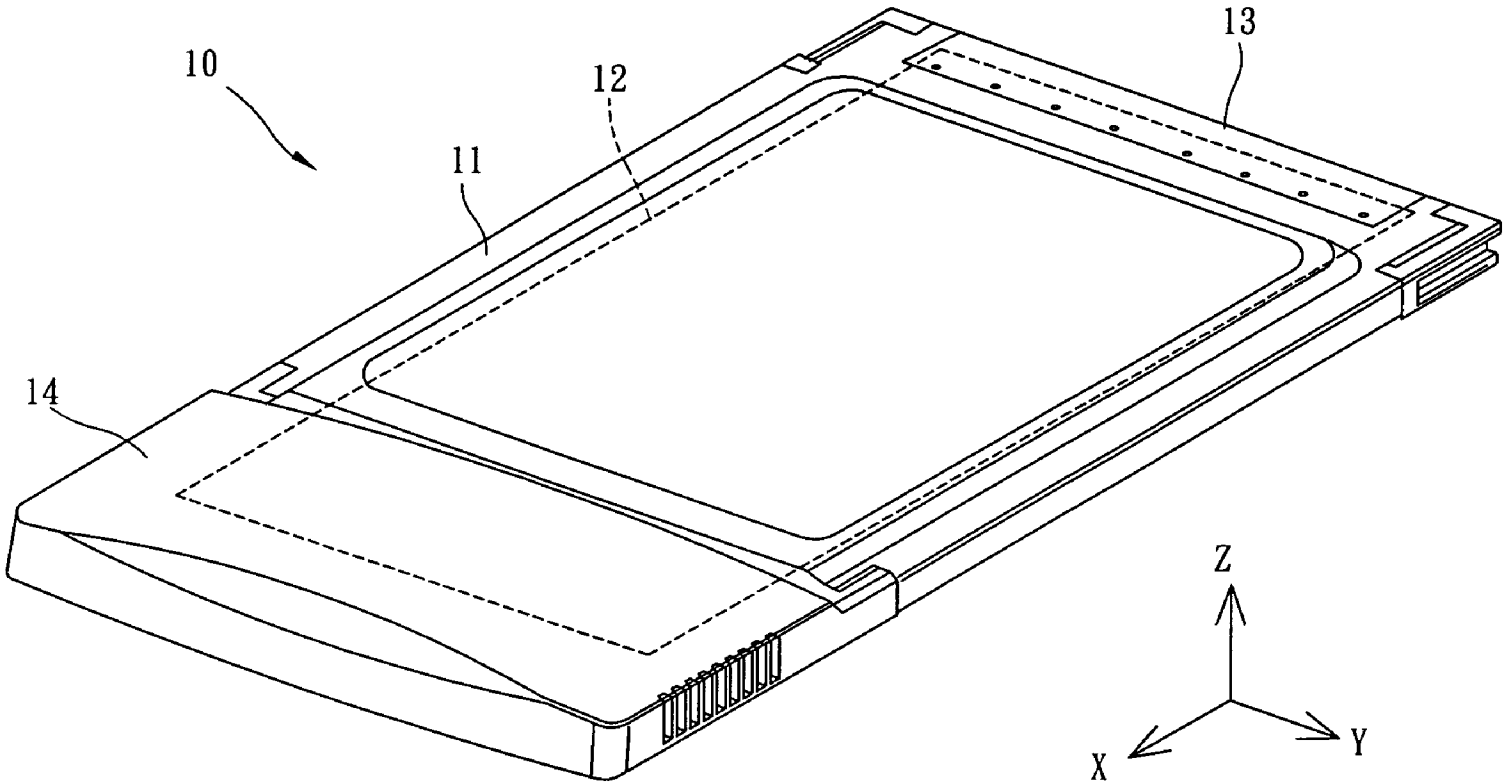
FIG. 1 (PRIOR ART)
FIG. 1 is an outline perspective view of a traditional wireless network device.
Figure 2:
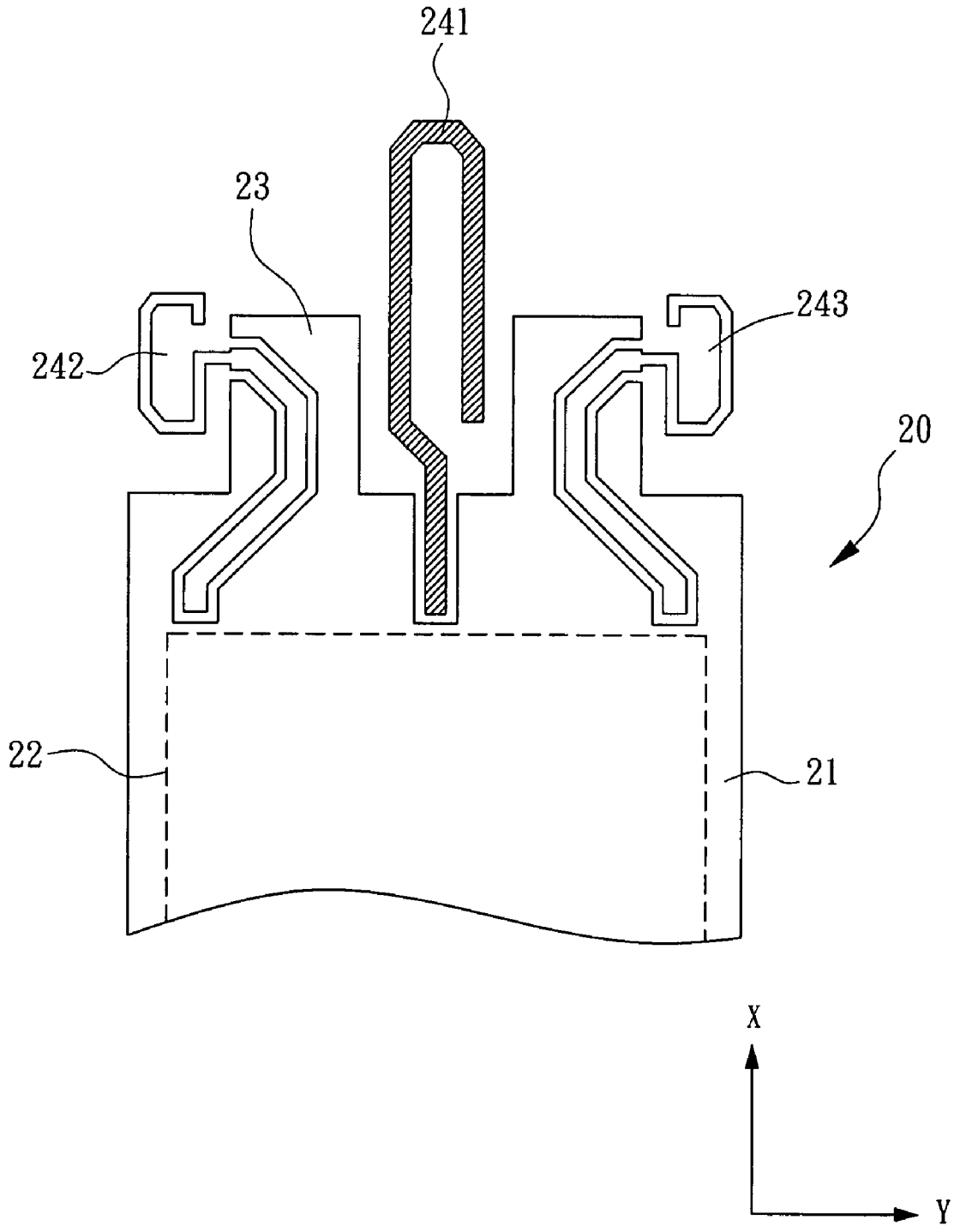
FIG. 2 (PRIOR ART)
FIG. 2 is a schematic view of a traditional internal circuit device of a MIMO wireless network device.
Figure 3:
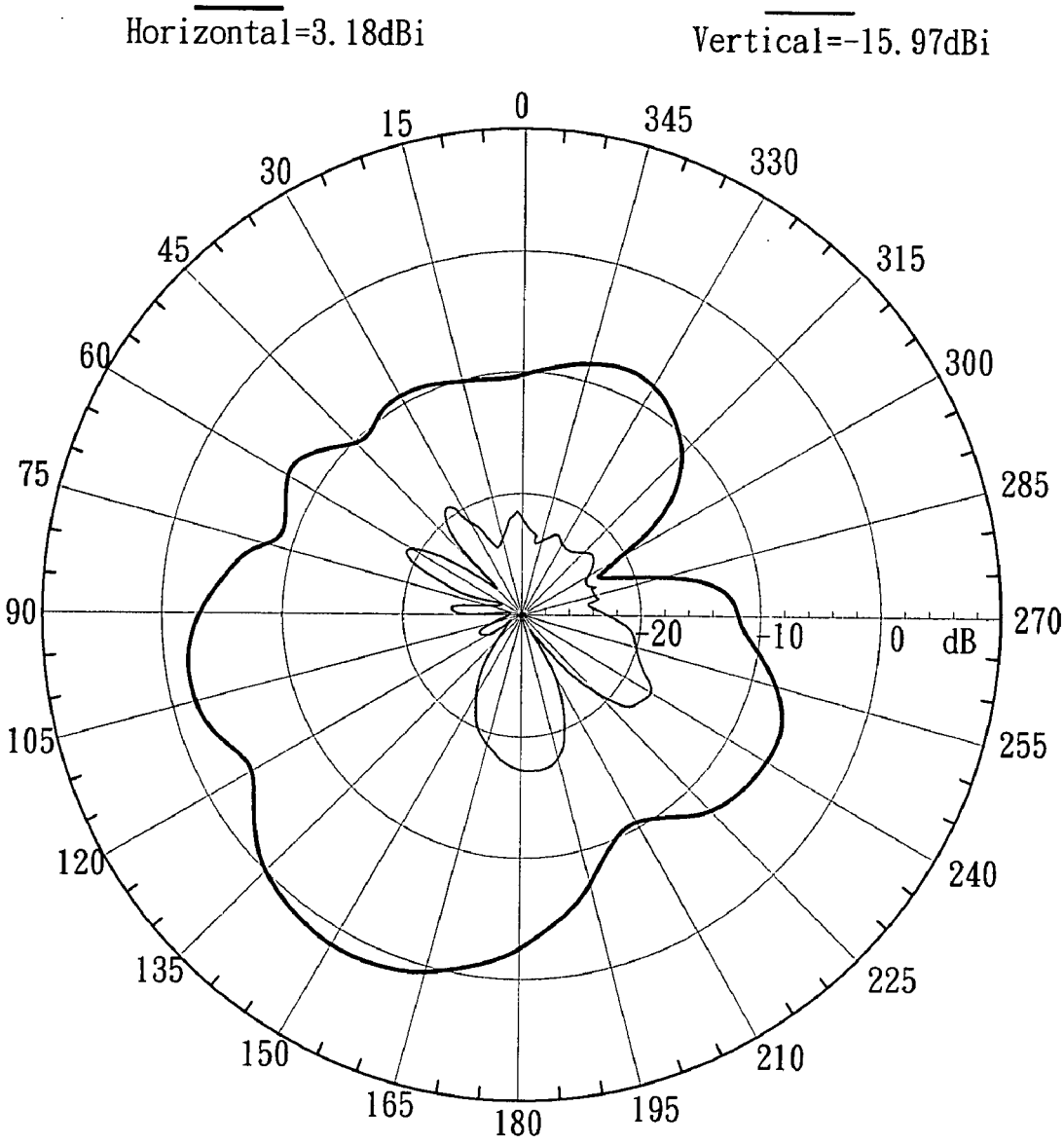
FIG. 3 (PRIOR ART)
FIG. 3 is a detected radiation pattern on an X-Y plane of the second antenna of the traditional MIMO antenna unit shown in FIG. 2.
Figure 4:
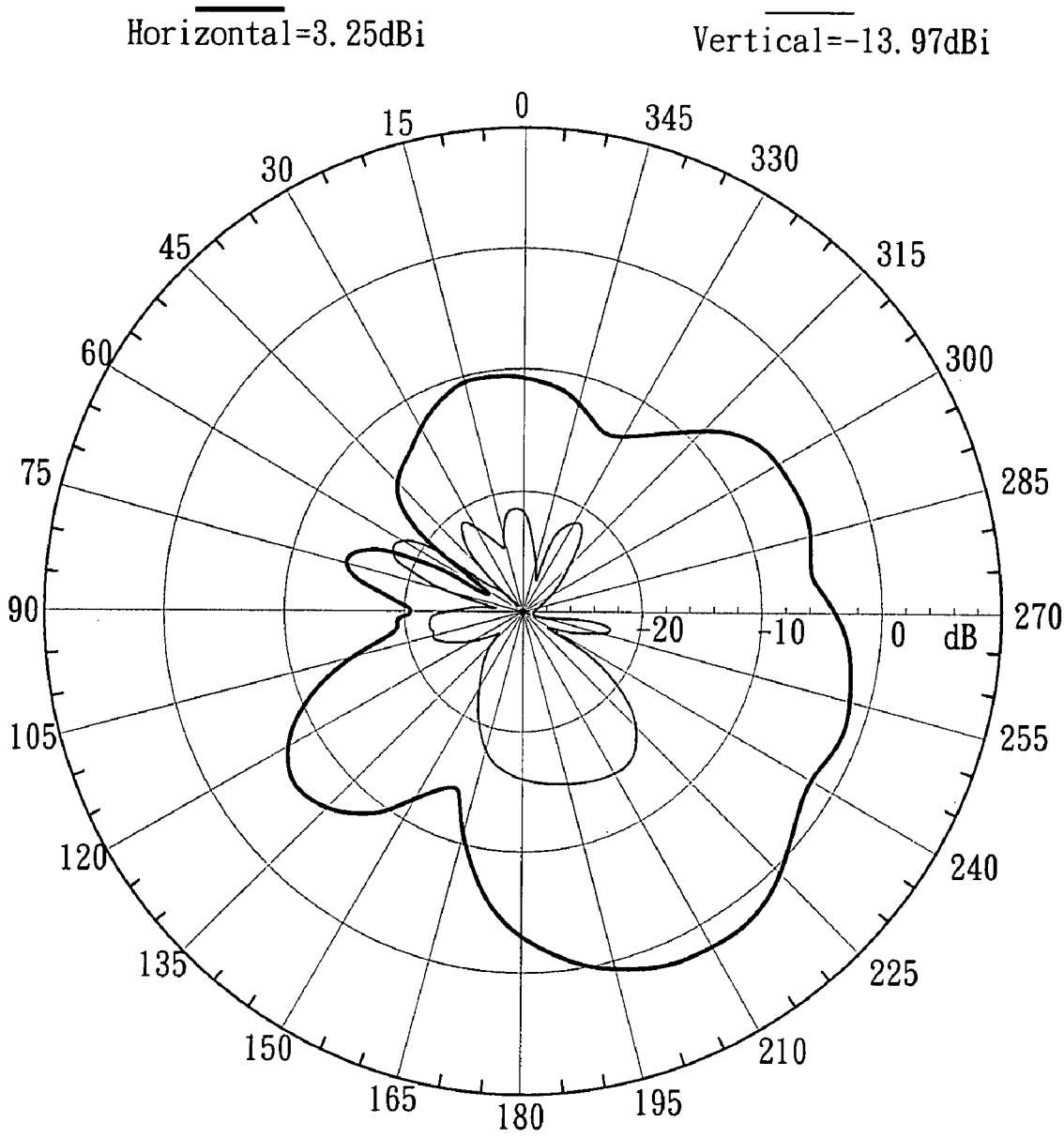
FIG. 4 (PRIOR ART)
FIG. 4 is a detected radiation pattern on an X-Y plane of the third antenna of the traditional MIMO antenna unit shown in FIG. 2.
Figure 9:
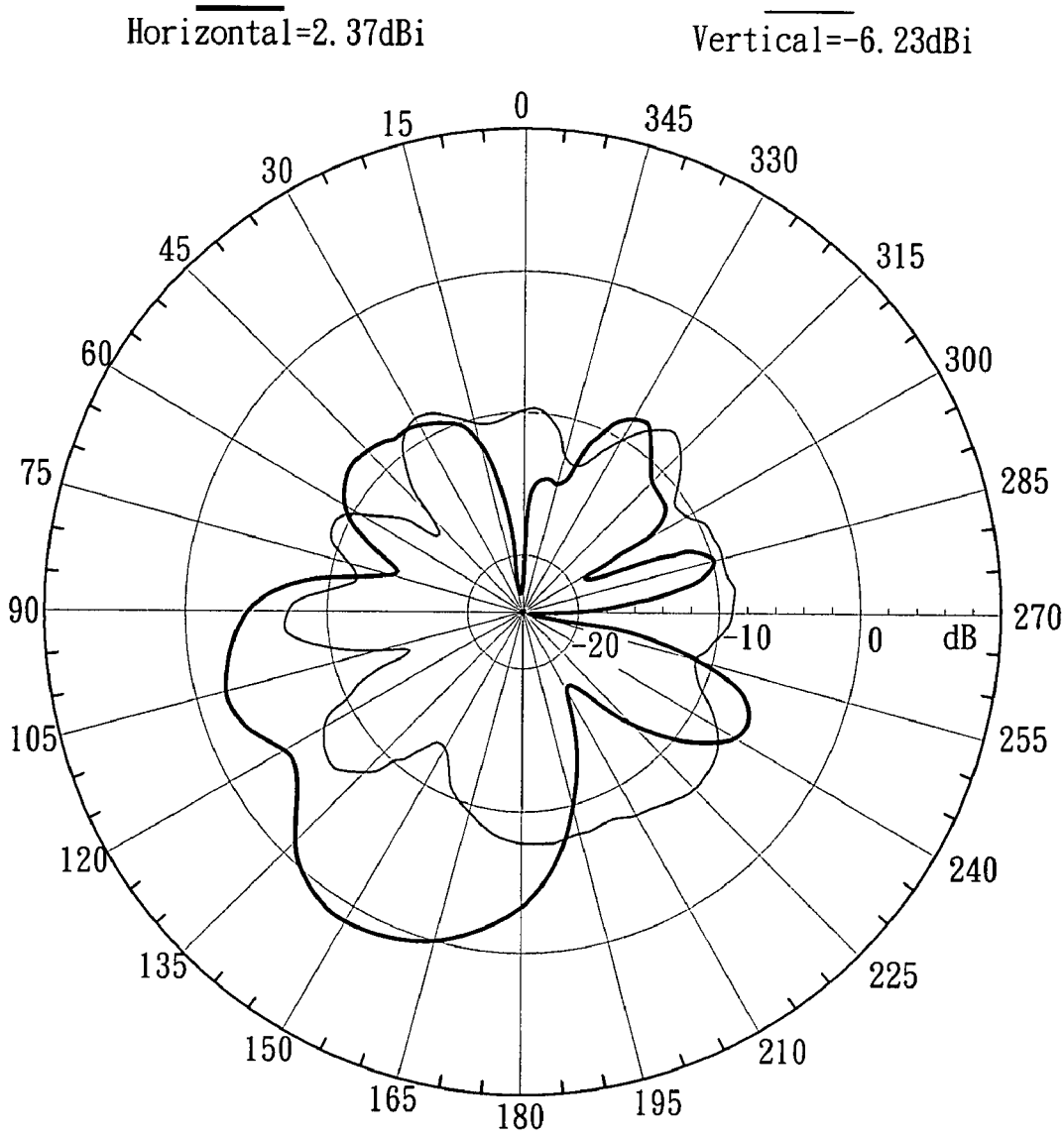
FIG. 9 is a detected radiation pattern on an X-Y plane of a left-side antenna of the antenna according to the preferred embodiment of the present invention shown in FIG. 8.
Figure 10:
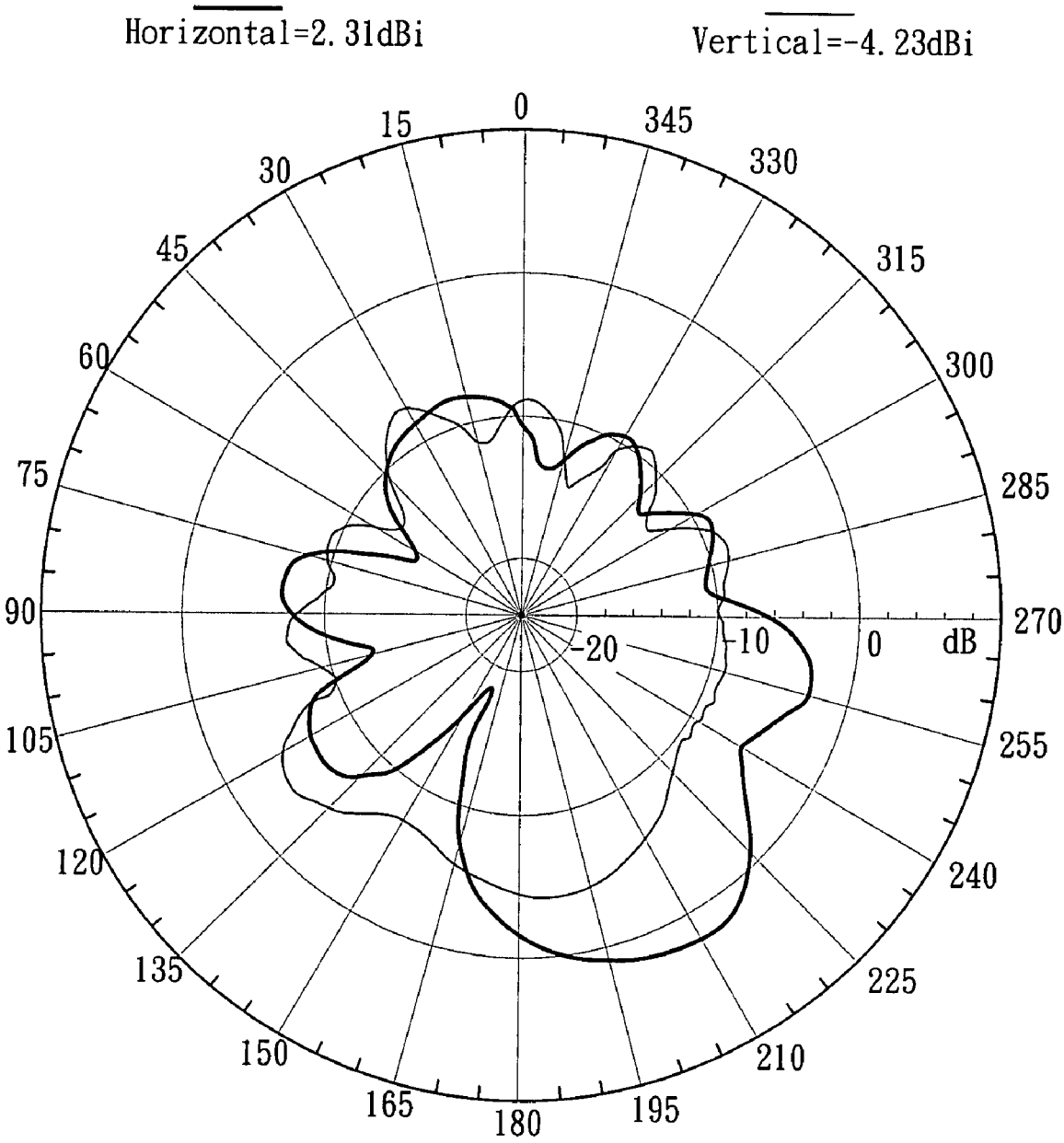
FIG. 10 is a detected radiation pattern on an X-Y plane of a right-side antenna of the antenna according to the preferred embodiment of the present invention shown in FIG. 8.

Referring now to FIGS. 9 and 10, two detected radiation patterns on an X-Y plane of a left-side antenna and a right-side antenna of the antenna according to the preferred embodiment of the present invention shown in FIG. 8 are illustrated. As shown in the detected radiation pattern of FIG. 9, the left-side antenna 5 has a gain value on the vertical direction about −6.23 dBi obviously higher than the gain value about −15.97 dBi of the traditional MIMO antenna unit 24 shown in FIG. 2. Meanwhile, as shown in the detected radiation pattern of FIG. 10, the right-side antenna 5 has a gain value on the vertical direction about −4.23 dBi obviously higher than the gain value about −13.97 dBi of the traditional MIMO antenna unit 24 shown in FIG. 2. Thus, in comparison with the traditional MIMO antenna unit 24, the antenna 5 of the present invention can be used to improve the communication quality and the transmission efficiency of wireless signals on the vertical direction of the wireless network device 6, so that the antenna 5 is more suitable to be applied to the wireless network device 6, especially a vertical stand type wireless network device.

The present invention has been described with a preferred embodiment thereof and it is understood that many changes and modifications in the described embodiment can be carried out without departing from the scope and the spirit of the invention that is intended to be limited only by the appended claims.

What is claimed is:

1. A plated inverted-F antenna, comprising:

a base having two sides opposite to each other;

a pair of embedded portions, each of the embedded portions having a side wall portion and a locking wing portion, wherein the side wall portion is substantially vertical to the base and connected to the sides of the base, and wherein the locking wing portion is connected to the side wall portion, substantially parallel to the base, and spaced apart from the base with a first height; and an antenna portion connected to the base and provided with a radiation member which is substantially parallel to the base, and spaced apart from the base with a second height greater than the first height.

2. The plated inverted-F antenna as claimed in claim 1, wherein the antenna is a punched conductive metal plate.

3. The plated inverted-F antenna as claimed in claim 1, wherein the radiation member is provided with a slot with a predetermined configuration, so that the radiation member is formed with an end portion.

4. The plated inverted-F antenna as claimed in claim 3, wherein the slot has an opening corresponding to a ground member of the antenna portion.

5. The plated inverted-F antenna as claimed in claim 1, wherein the antenna portion further comprises:

a ground member substantially vertical to the base, connected to one of the two sides of the base, and further connected to the radiation member; and a signal member connected to the radiation member, substantially vertical to the base, and formed with a free end separated from the base.

6. The plated inverted-F antenna as claimed in claim 5, wherein the antenna is embedded in a substrate which has a thickness substantially corresponding to the first height, the substrate further comprises:

at least one slot having a configuration substantially corresponding to a configuration of the base of the antenna, so that the base of the antenna is directly embedded into the slot and at least one of the embedded portions is attached to an upper surface of the substrate;

a control circuit for providing a wireless transmission function;

a ground portion electrically grounded, and electrically connected to the base; and at least one feed line connected between the control circuit and the signal member.

7. The plated inverted-F antenna as claimed in claim 1, wherein the first height is ranged from 0.3 mm to 2.0 mm, and the second height is ranged from 2.5 mm to 12.0 mm.

* * * * *